US006981606B2

(12) United States Patent
Yang et al.

(10) Patent No.: US 6,981,606 B2
(45) Date of Patent: Jan. 3, 2006

(54) TRASH CAN ASSEMBLY

(75) Inventors: Frank Yang, Palos Verdes Peninsula, CA (US); Joseph Sandor, Santa Ana Heights, CA (US); Alex Grande Fermin, Jr., Huntington Beach, CA (US); Myk Wayne Lum, Irvine, CA (US); Adam Courtney Wade, Rancho Santa Margarita, CA (US)

(73) Assignee: Simplehuman LLC, Torrance, CA (US)

( * ) Notice: Subject to any disclaimer, the term of this patent is extended or adjusted under 35 U.S.C. 154(b) by 0 days.

(21) Appl. No.: 10/131,430

(22) Filed: Apr. 24, 2002

(65) Prior Publication Data

US 2003/0201267 A1 Oct. 30, 2003

(51) Int. Cl.
*B65F 1/08* (2006.01)
*B65F 1/16* (2006.01)

(52) U.S. Cl. ..... 220/23.87; 220/263; 220/264; 220/826; 220/908.1

(58) Field of Classification Search ..... 220/263, 220/826, 908, 264, 262, 810, 827, 830, 495.08, 220/23.87, 23.88, 23.89, 23.9, 908.1
See application file for complete search history.

(56) References Cited

U.S. PATENT DOCUMENTS 2,946,474 A * 7/1960 Knapp ..... 220/23.87
3,825,215 A * 7/1974 Borglum ..... 248/147
3,891,115 A * 6/1975 Ono ..... 220/260
4,765,548 A * 8/1988 Sing ..... 241/101.3
4,913,308 A * 4/1990 Culbertson ..... 220/495.09
4,953,740 A * 9/1990 Koda ..... 220/263
5,067,625 A * 11/1991 Numata ..... 220/827
5,170,904 A * 12/1992 Neuhaus ..... 220/262
5,269,435 A * 12/1993 Hallock, III ..... 220/495.08
5,322,179 A * 6/1994 Ting ..... 220/495.07
5,348,222 A * 9/1994 Patey ..... 232/43.2
5,471,708 A * 12/1995 Lynch ..... 16/66
5,476,187 A * 12/1995 Marisco ..... 220/495.08
5,893,478 A * 4/1999 Maruoka ..... 16/354
5,971,194 A * 10/1999 Freedland ..... 220/495.08
6,000,569 A * 12/1999 Liu ..... 220/263
6,010,024 A * 1/2000 Wang ..... 220/23.87
6,024,238 A * 2/2000 Jaros ..... 220/264
6,209,744 B1 * 4/2001 Gill ..... 220/263
6,332,551 B1 * 12/2001 Copeland ..... 220/262
6,390,321 B1 * 5/2002 Wang ..... 220/264
6,626,317 B2 * 9/2003 Pfiefer et al. ..... 220/263

FOREIGN PATENT DOCUMENTS

DE 1283741 7/1966

(Continued)

OTHER PUBLICATIONS

Trento Corner 23 trash can, Hailo brochure, p. 3.

*Primary Examiner*—Lee Young
*Assistant Examiner*—Niki M. Eloshway
(74) *Attorney, Agent, or Firm*—Raymond Sun

(57) ABSTRACT

A trash can assembly has a shell, a lid fitted over the top end of the shell, a pedal positioned adjacent the bottom end of the shell, a link assembly coupling the pedal and the lid, and a motion damper coupled to the link assembly for slowing the closing motion of the lid. The assembly also includes an inner liner that is retained inside the shell, with a support frame secured to the top end of the shell and having a ridge on which a peripheral lip of the inner liner rests.

7 Claims, 7 Drawing Sheets

FOREIGN PATENT DOCUMENTS

| | | |
|---|---|---|
| EP | 1 136 393 | 5/2000 |
| EP | 1 094 017 | 10/2000 |

* cited by examiner

TRASH CAN ASSEMBLY

BACKGROUND OF THE INVENTION

1. Field of the Invention

The present invention relates to household items, and in particular, to a trash can assembly that incorporates a number of improvements and enhancements.

2. Description of the Prior Art

A major concern for both the home and the workplace is containing and holding wastes, refuse, and trash until permanent disposal. Trash cans act as containers for holding trash and other wastes that are produced in any typical home or office. Trash and garbage cans often employ lids and covers to contain the trash and its associated odor, to hide the trash from view, and to prevent the trash from contaminating areas beyond the lid.

Conventional trash cans have been improved over the years to make them more user-friendly, sanitary, and hygienic. For example, many trash cans are now provided with a foot pedal positioned adjacent the base of the trash can so that a user can step on the foot pedal to open the lid of the trash can, thereby freeing up the user's hands to deposit trash, or to change the plastic liner or bag that is used to line the trash can. Other trash cans have even provided an interior metal or plastic liner that fits inside the trash can, and which can be removed to be washed. However, these conventional trash cans still suffer from a number of drawbacks.

For example, the foot pedals on some of the conventional trash cans are noisy to use. In particular, stepping on a foot pedal of a conventional trash can often results in a loud banging noise as the lid is opened, and releasing the step on the foot pedal will also result in another loud banging noise as the lid slams shut under the force of gravity. These banging actions also result in wear and tear to the contacting parts.

Other problems are associated with the internal liner. In conventional trash cans that use an internal liner, the user typically needs to remove the internal liner from the trash can to dispose of the contents therein. To do so, the user typically lifts the internal liner from the trash can, and this may result in the user gripping portions of the surfaces of the internal liner (or a trash bag that lines the internal liner), so that the user's fingers may come into contact with dirt, germs or trash items. In many of the conventional trash cans, there are no good ways to grip and hold the internal liner without the user's fingers actually contacting the surface of the trash bag that lines the internal liner, or the surface of the internal liner itself.

Thus, there remains a need for a trash can that overcomes the drawbacks identified above.

SUMMARY OF THE DISCLOSURE

It is an object of the present invention to provide a trash can assembly that reduces noise and wear when the step pedal is actuated to open and close the lid.

It is another object of the present invention to provide a trash can assembly that allows the user to remove an internal liner in a sanitary manner.

In order to accomplish the objects of the present invention, there is provided a trash can assembly that has a shell having an enclosing wall. The assembly has a lid fitted over the top end of the shell, a pedal positioned adjacent the bottom end of the shell, a link assembly coupling the pedal and the lid, and a motion damper coupled to the link assembly for slowing the closing motion of the lid.

In accordance with another embodiment of the present invention, the assembly can also include an inner liner that is retained inside the shell, the inner liner having a peripheral lip, and a support frame secured to the top end of the shell, the support frame having a ridge on which the lip of the inner liner rests, and with the support frame further including a groove adjacent the inner liner.

DETAILED DESCRIPTION OF THE PREFERRED EMBODIMENTS

Figure 1:
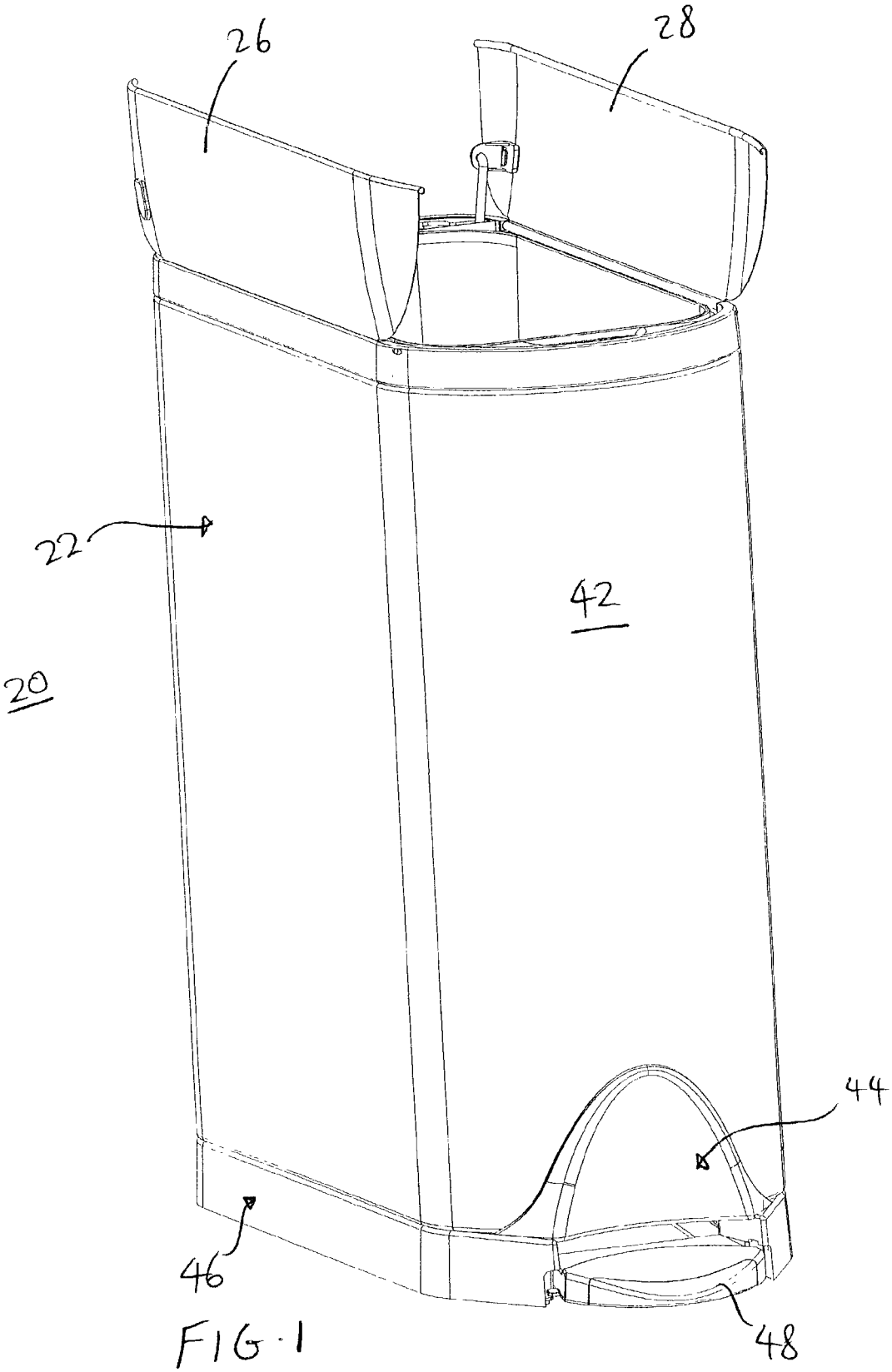
FIG. 1 is a front perspective view of a trash can assembly according to one embodiment of the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

FIGS. 1–9 illustrate one embodiment of a trash can assembly 20 according to the present invention. The assembly 20 has an outer shell 22 and an inner liner 24 that is adapted to be retained inside the outer shell 22.

The outer shell 22 is a four-sided shell that has four side walls, including a front wall 42. It is also possible to provide the outer shell 22 in a generally cylindrical, oval or egg shape. The inner liner 24 can have the same, or different, shape as the outer shell 22. The lid is made up of two separate lid portions 26 and 28 that are split at about the center of the outer shell 22, each of which is hingedly connected to an upper support frame 130 (see FIG. 7) along a top side edge of the outer shell 22 in a manner such that the lid portions 26, 28 pivot away from each other (see arrows AA in FIG. 4) when they are opened. The outer shell 22 and its lid portions 26 and 28 can be made of a solid and stable material, such as a metal. The upper support frame 130 can be secured to the opened top of the outer shell 22, and can be provided in a separate material (e.g., plastic) from the outer shell 22. Each lid portion 26, 28 has a side edge 30 that has a sleeve 32 extending along the side edge 30. A shaft (not shown) is retained inside the sleeve 32 and has opposing ends that are secured to one side edge of the upper support frame 130, so that the lid portion 26, 28 can pivot about an axis defined by the shaft and its corresponding sleeve 32. An L-shaped bracket 34 is secured at the rear end of each lid portion 26, 28. One leg of the bracket 34 is secured to the underside of the lid portion 26, 28, and the other leg of the bracket 34 has an opening 40 that is adapted to receive an upper hooked end 36 of a corresponding lifting rod 38.

In addition, a toe-kick recess 44 can be provided on the outer shell 22 adjacent the base 46 of the outer shell 22, and is adapted to receive a foot pedal 48 that is pivotably secured to a pedal bar 60 in the base 46. The toe-kick recess 44 can be formed as part of the base 46, and the outer shell 22 would define a curved cut-out to receive the recess 44. The curved cut-out in the shell 22 can be made by first cutting out a properly sized and configured hole in the body of the outer shell 22, and then inserting a plastic curved panel that defines the actual recess 44. The recess 44 extends into the interior confines of the outer shell 22 (as defined by the periphery of the outer shell 22). The recess 44 also extends upwardly for a short distance from the base 46. The pedal bar 60 is made of a material (e.g., metal) that carries some weight, and extends from the foot pedal 48 along the base 46 and is then pivotably coupled to the lifting rods 38 that extend upwardly along the rear of the outer shell 22 to connect the lid portions 26, 28. The pedal bar 60 and the lifting rods 38 operate to translate an up-down pivot motion of the pedal 48 to an up-down pivot motion for the lid portions 26, 28. Each of these components will be described in greater detail hereinbelow.

Figure 3:
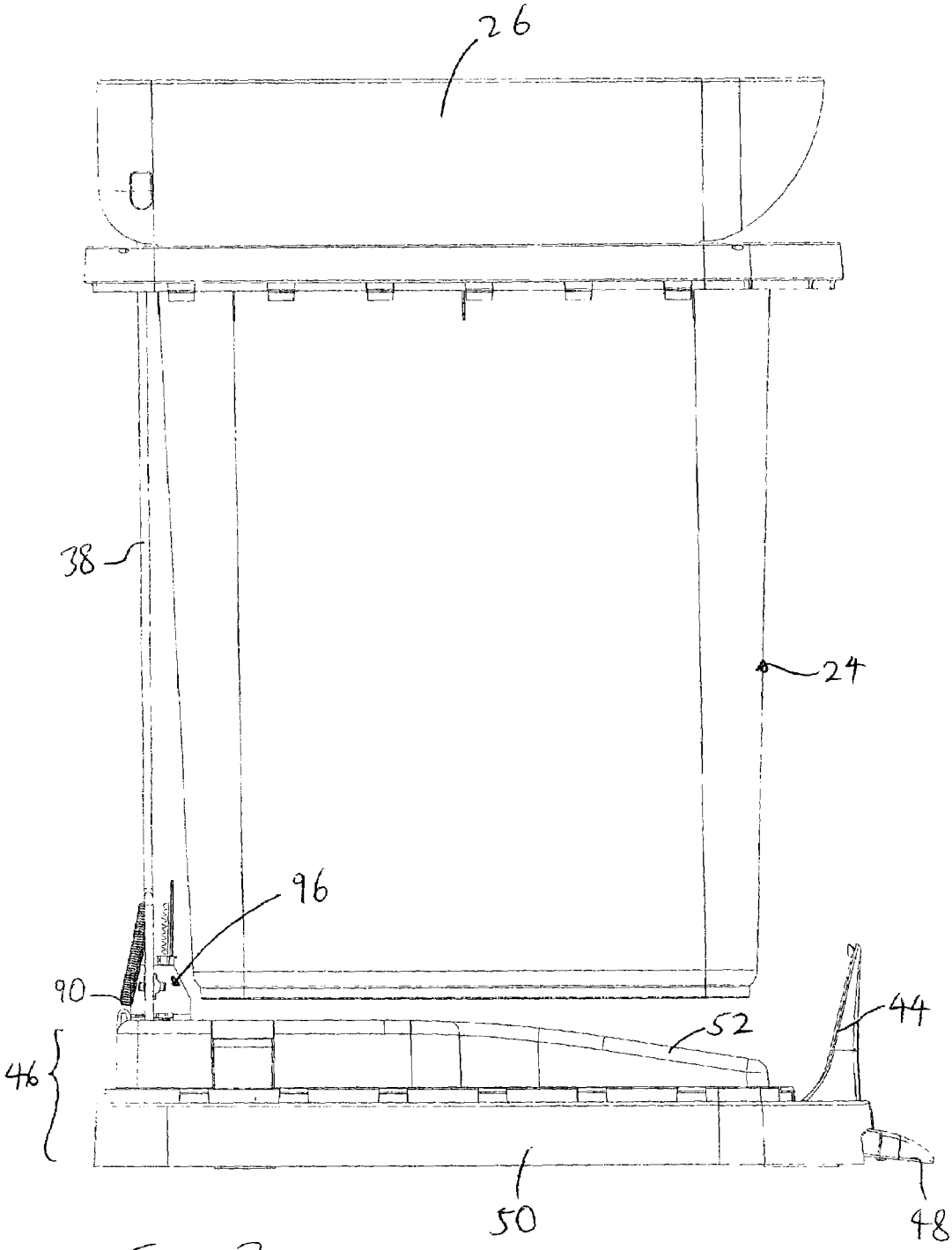
FIG. 3 is a side plan view of the trash can assembly of FIG. 1 shown without the outer shell.
Figure 4:
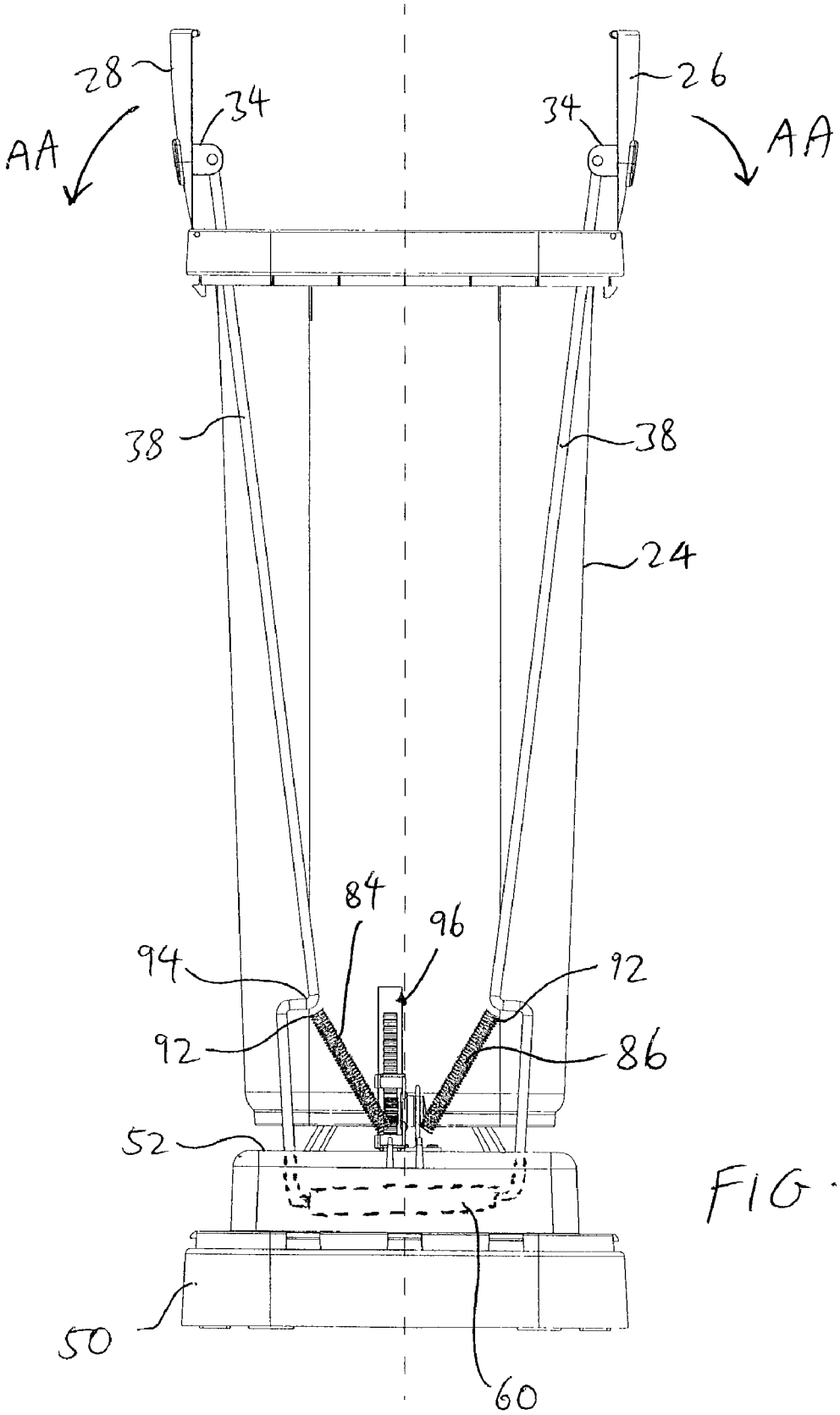
FIG. 4 is a rear view of the trash can assembly of FIG. 1 shown without the outer shell.
Figure 5:
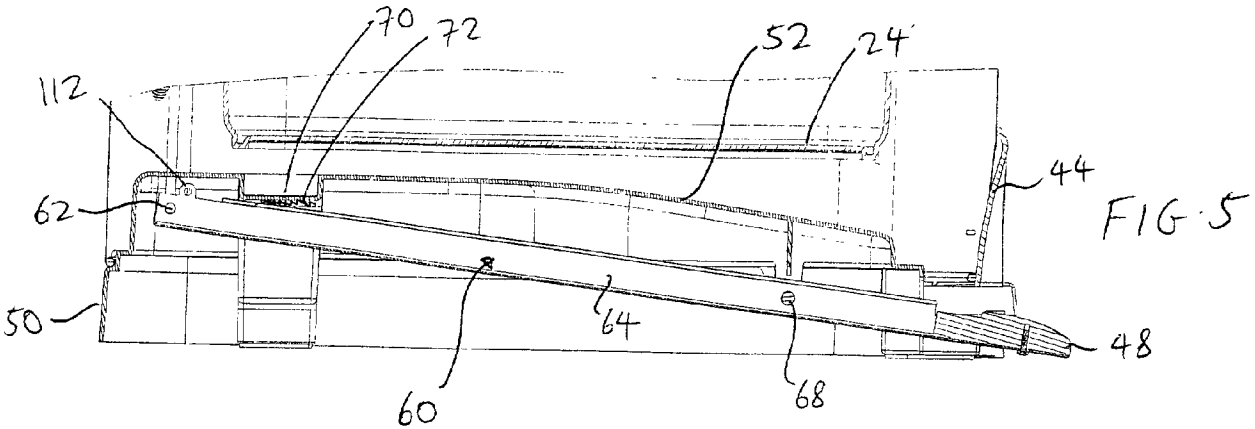
FIG. 5 is an enlarged cross-sectional side view of the base of the trash can assembly of FIG. 1.
Figure 6:
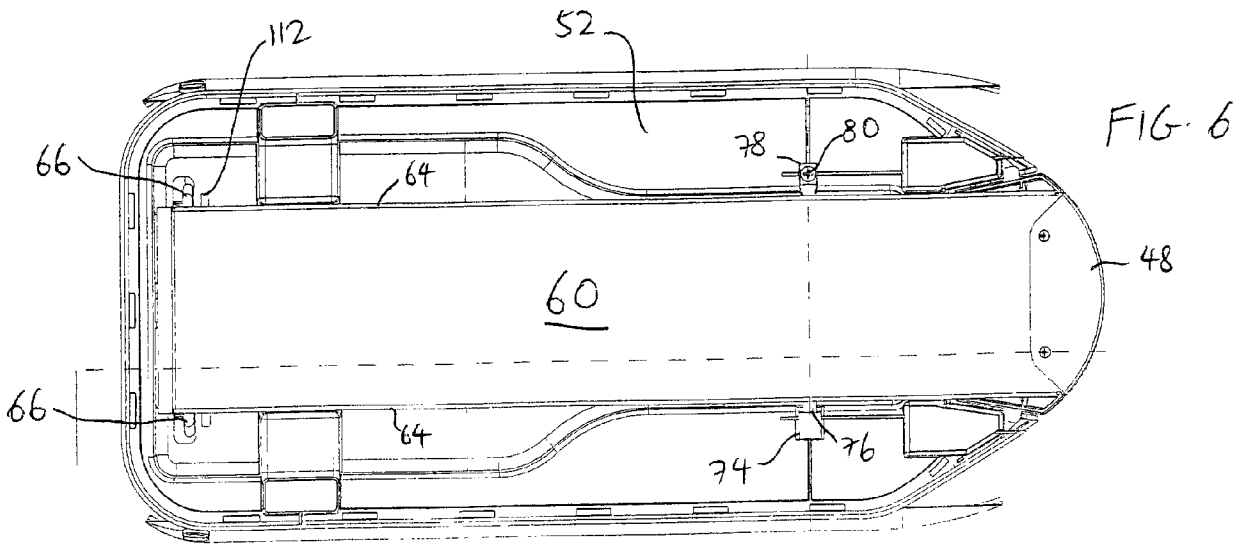
FIG. 6 is a bottom plan view of the trash can assembly of FIG. 1 shown without the outer shell.
Figure 8:
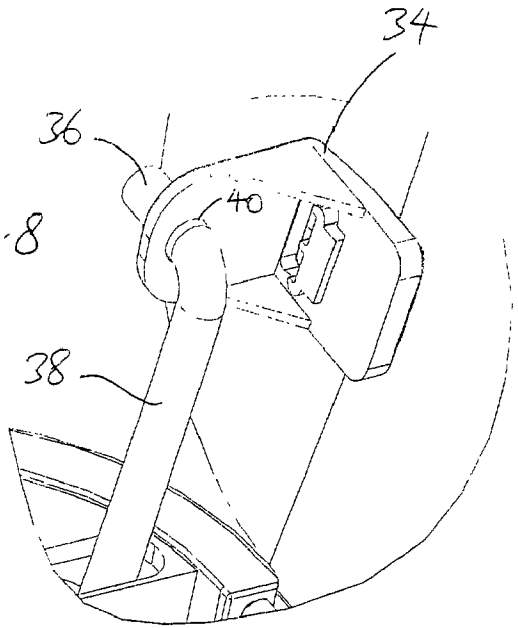
FIG. 8 is an enlarged view of the area labeled X in FIG. 7.

Referring now to FIGS. 3–6, the base 46 of the outer shell 22 has a raised or domed base panel 52 and a skirt or flange portion 50 that extends from the base panel 52. In one embodiment of the present invention, the base panel 52, the skirt 50 and the recess 44 can be formed in one plastic piece. The pedal bar 60 is retained under the base panel 52 and inside the skirt 50. The pedal bar 60 has two short side walls 64. The front of the pedal bar 60 is attached to the pedal 48, and the rear of the pedal bar 60 has two opposite holes 62. One of the holes 62 is provided on each of the two opposing side walls 64, and each hole 62 receives a lower hooked end 66 of a corresponding lifting rod 38. A fulcrum rod 68 extends through the two side walls 64 of the pedal bar 60 at a location that is closer to the front of the pedal bar 60 than the rear of the pedal bar 60. Thus, the pedal bar 60 can be pivoted about a pivot axis defined by the fulcrum rod 68. In particular, the pedal bar 60 can be pivoted between two positions, a first rest position as shown in FIG. 2 where the pedal 48 is at a vertically higher position than the rear of the pedal bar 60, and a second open position (where the lid portions 26, 28 are opened) as shown in FIG. 5 where the pedal 48 is pressed to a vertically lower position than the rear of the pedal bar 60.

Figure 2:
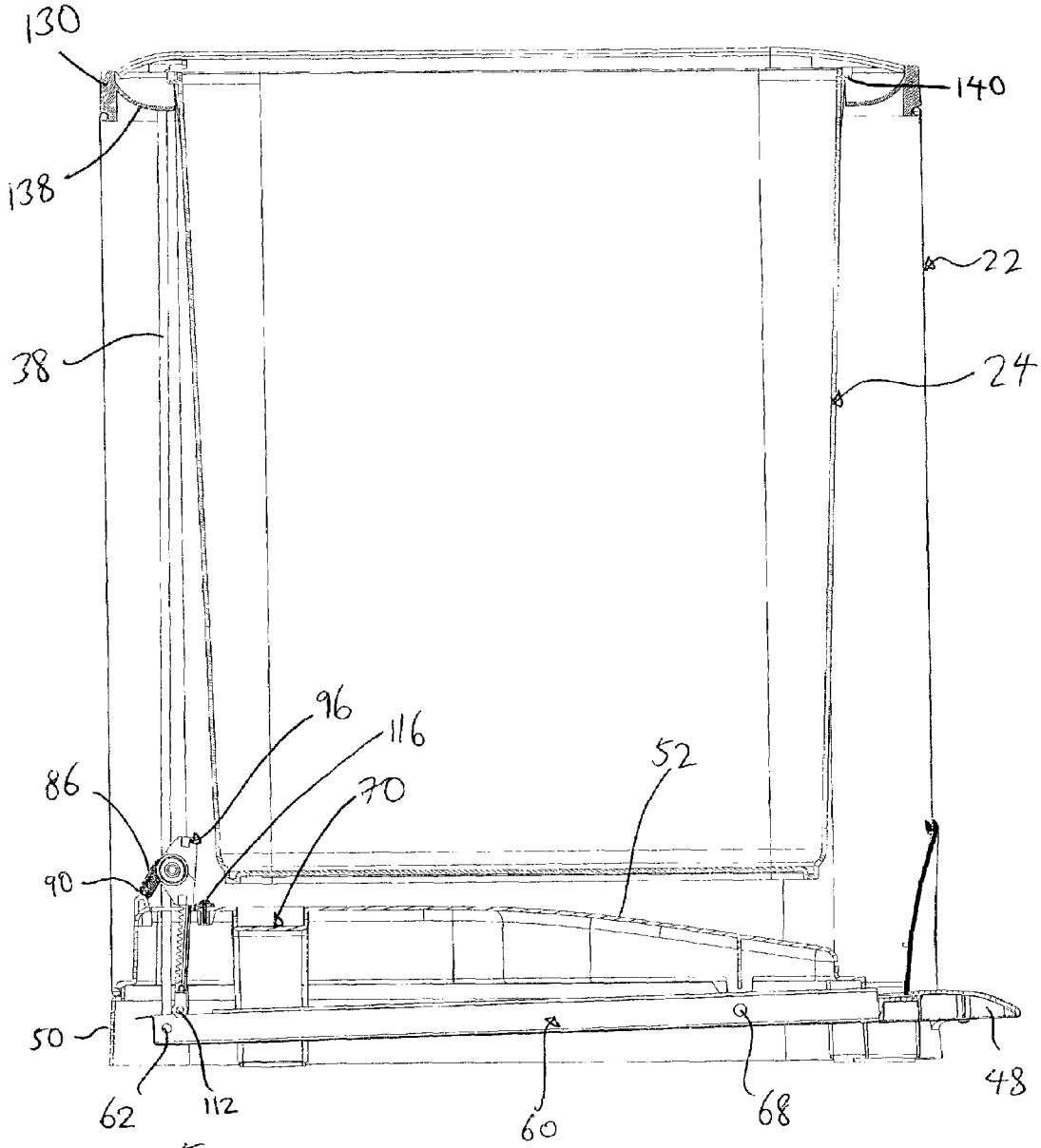
FIG. 2 is a cross-sectional side view of the trash can assembly of FIG. 1.

Thus, the fulcrum rod 68 is positioned at a location that is closer to the front of the pedal bar 60 than the rear of the pedal bar 60 so that the portion of the pedal bar 60 that is rearward of the fulcrum rod 68 would be greater (and therefore heavier) than the portion of the pedal bar 60 that is forward of the pedal bar 60, thereby causing the rear of the pedal bar 60 to be at a vertically lower position than the pedal 48 when in the rest position of FIG. 2.

As shown in FIG. 5, the base panel 52 defines a recessed region 70 with a soft material 72 (e.g., a foam sponge) secured below the recessed region 70. The recessed region 70 acts as a stop member in that it prevents the rear of the pedal bar 60 from being raised to a vertical level that exceeds the vertical position of the recessed region 70, as shown in FIG. 5. The soft material 72 therefore functions as a noise and contact absorber so that there will be minimal noise and wear on the pedal bar 60 when it contacts the recessed region 70.

In many applications, given the dimensions of the base 46, it will be difficult to first position the pedal bar 60 inside the base 46 and then attempt to fit a lengthy fulcrum rod inside the base 46 and insert the fulcrum rod through the pedal bar 60. Therefore, the present invention provides a novel method for securing the fulcrum rod 68 in its desired position with respect to the base 46 and the pedal bar 60. First, referring to FIG. 6, the base panel 52 is provided with a column 74 that extends vertically downwardly from the base panel 52, and the column 74 has a horizontal bore (not shown) that opens towards the center of the base 46. Next, the fulcrum rod 68 is extended through opposing and aligned openings in the two side walls 64 so that the two opposing ends 76, 78 of the fulcrum rod 68 extend beyond the side walls 64. In the next step, the pedal bar 60 and the fulcrum rod 68 are positioned inside the base panel 52, with one end 76 of the fulcrum rod 68 positioned inside the bore of the column 74. The other end 78 of the fulcrum rod 68 has a flat configuration with a hole (not shown), so that a screw 80 can be threaded through the hole in the end 78 to secure the fulcrum rod 68 to the base panel 52.

A pair of springs 84 and 86 are provided to normally bias the lid portions 26, 28 to the closed position shown in FIG. 2. Referring to FIGS. 2–4, each spring 84, 86 has a first end 90 that is secured to the base panel 52, and a second end 92 that is secured to a bent portion 94 of one of the lifting rods 38. Thus, when the assembly 20 is not experiencing any external forces (i.e., it is in the closed position), the springs 84, 86 will normally bias the lifting rods 38 in the downward vertical direction, thereby causing the lid portions 26, 28 to be closed. The springs 84, 86 also prevent the lower hooked ends 66 from becoming disengaged from the rear of the pedal bar 60, and takes out any slack in the linkage involving the lifting rods 38.

The assembly 20 provides a motion damper 96 that functions to dampen the closing motion of the lid portions 26, 28 so that the lid portions 26, 28 can close slowly and not experience a hard slamming motion. The motion damper 96 is illustrated in greater detail in FIG. 9, and can be embodied in the form of the "Rotary Motion Damper" sold by ITW Delpro of Frankfort, Ill., although other known and conventional motion dampers can be utilized without departing from the scope of the present invention. The motion damper 96 has a toothed bar 98 with a row of teeth 100 positioned along a side thereof. One end of the toothed bar 98 has a pair of aligned openings 102. A platform 104 has a pair of guides 106 that receive the toothed bar 98. A toothed damping wheel 108 is carried on the platform 104 and is adapted to engage the teeth 100 on the toothed bar 98 as the platform 104 experiences relative movement in both directions (see arrows A and B) along the toothed bar 98. Assuming that the damping wheel 108 remains stationary, when the toothed bar 98 moves in the direction B, the damping wheel 108 does not offer any resistance so the toothed bar 98 can move smoothly and quickly in the direction B. However, when the toothed bar 98 moves in the direction A, the damping wheel 108 does offer resistance so the toothed bar 98 can only move very slowly in the direction A. The motion damper 96 is positioned in the interior of the outer shell 22, and is secured to both the base panel 52 and the pedal bar 60. In particular, the platform 104 has a connecting element 110 that is secured to a bracket (not shown) in the base panel 52. The bracket can be secured to the base panel 52 by a screw 116 as shown in FIG. 2. In addition, the end of the toothed bar 98 with the aligned openings 102 extends through an opening in the base panel 52, and a damping rod 112 secured to the pedal bar 60 extends through the openings 102 (see FIGS. 5 and 6) to couple the toothed bar 98 to the pedal bar 60. Thus, the platform 104 of the motion damper 96 is essentially fixed at a stationary position with respect to the base panel 52, and the toothed bar 98 can be moved up or down (i.e., in the directions B or A) as the rear end of the pedal bar 60 is pivoted up or down by the pedal 48.

The operation of the trash can assembly 20 will now be described. When the assembly 20 is not in use, the lid portions 26, 28 are normally closed as shown in FIG. 2. At this position, the springs 84 and 86 are relaxed and do not exert any bias. To open the lid portions 26, 28, the user steps on the pedal 48, which pivots the pedal bar 60 about the fulcrum rod 68 with the pedal 48 moving vertically downward, and the rear end of the pedal bar 60 being pivoted vertically upwardly. The soft material 72 provides a buffer or absorber to minimize any noise that may be caused by the pedal bar 60 contacting the recessed region 70. As shown in FIGS. 3–5 and 7–8, the rear end of the pedal bar 60 pushes the lifting rods 38 upwardly, so that the lifting rods 38 will push the lid portions 26, 28 open about the pivoting of the shafts in the sleeves 32. The lid portions 26, 28 will pivot away from each other to expose the top of the of the outer shell 22. Simultaneously, the damping rod 112 will push the toothed bar 98 upwardly (i.e., in the direction B in FIG. 9). As described above, the damping wheel 108 will not offer any resistance to the movement of the toothed bar 98, so the entire lifting motion of the rear of the pedal bar 60 and the lifting rods 38 will be smooth and relatively quick. At this opened position, the springs 84 and 86 are stretched and therefore biased. As long as the user maintains his or her step on the pedal 48, the bias of the springs 84, 86 is overcome, the rear of the pedal bar 60 will remain in the position shown in FIG. 5, and the lid portions 26, 28 will remain opened.

When the user releases the pedal 48, the combined weight of the pedal bar 60 (i.e., a pulling force) and the lid portions 26, 28 (i.e., pushing forces), as well as gravity and the natural bias of the springs 84, 86, will cause the lid portions 26, 28 will pivot downwardly to their closed positions. In other words, the lifting rods 38, the toothed bar 98 and the pedal bar 60 will all experience a downward motion. In this regard, the fact that the fulcrum rod 68 is positioned closer to the pedal 48 (i.e., the front of the pedal bar 60) means that the rear of the pedal bar 60 is actually heavier, and will exert a force to aid in pulling the lifting rods 38 down in a vertical direction. However, the damping wheel 108 will resist the downward vertical movement (i.e., in the direction of arrow A in FIG. 9) of the toothed bar 98, so the entire downward motion of the rear of the pedal bar 60 and the lifting rods 38 will be slowed. By slowing this downward motion of the pedal bar 60 and the lifting rods 38, the lid portions 26, 28 will close slowly, and the pedal bar 60 will be lowered slowly, all to avoid any annoying loud slamming actions or noises.

Figure 7:
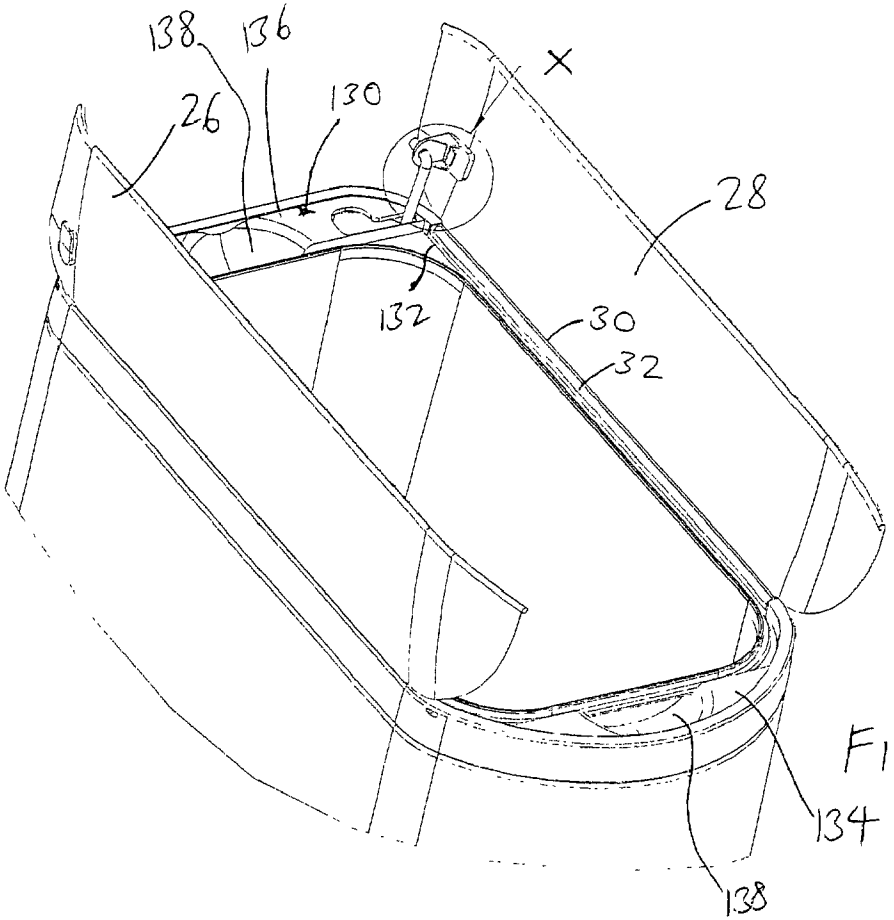
FIG. 7 is an enlarged top perspective view of the upper part of the trash can assembly of FIG. 1.
Figure 9:
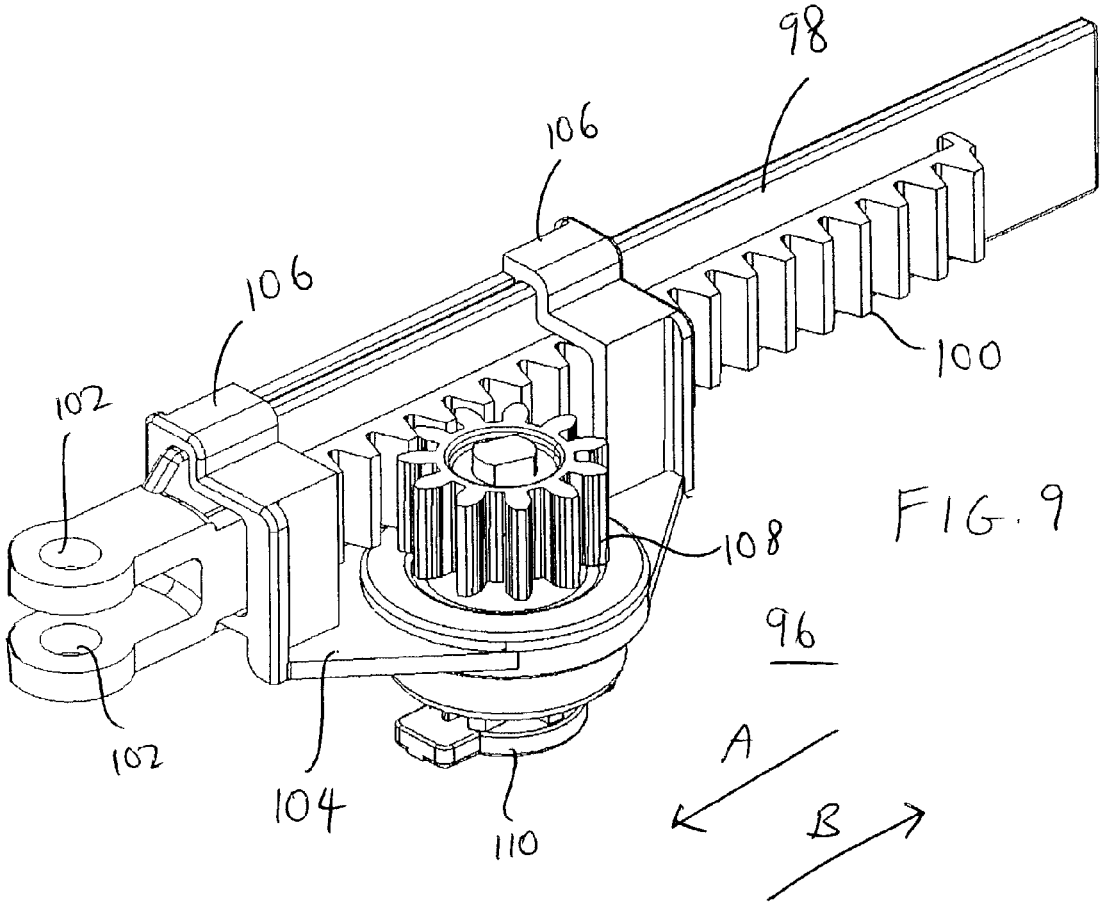
FIG. 9 is an isolated perspective view of a motion damper that can be used with the assembly of FIG. 1.

Referring now to FIGS. 2 and 7, the upper support frame 130 has a border shoulder 132 that extends along its inner periphery which is adapted to receive the upper lip 140 of the inner liner 24 so that the inner liner 24 can be suspended on the shoulder 132 inside the outer shell 22 during use. The support frame 130 has opposing ends 134 and 136, with a scalloped groove 138 formed in each end 134, 136. The scalloped grooves 138 allow the user to insert his or her fingers into the grooves 138 under the upper lip of the inner liner 24 to lift the inner liner 24 from the interior of the outer shell 24 when the lid portions 26, 28 are opened. This provides a convenient way or the user to remove the inner liner 24 from the outer shell 22, without requiring the user to grab or grip unnecessarily large portions of the inner liner 24.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A trash can assembly, comprising:

a shell having a top end and a bottom end, the shell having an enclosing wall;

a lid fitted over the top end;

a pedal positioned adjacent the bottom end;

a link assembly coupling the pedal and the lid;

an inner liner that is retained inside the shell, the inner liner having a peripheral lip; and a support frame secured to a portion the top end of the shell, the support frame having a border shoulder on which the lip of the inner liner rests, the border shoulder extending inwardly from the enclosing wall, and the support frame further including a groove cut from a portion of the border shoulder and positioned adjacent the inner liner in a manner such that a space is defined between an edge of the groove and the lip of the inner liner.

2. The assembly of claim 1, wherein the link assembly includes:

a pedal bar having a rear, and a front connected to the pedal; and a lifting rod having a lower end coupled to the rear of the pedal bar, and an upper end coupled to the lid.

3. The assembly of claim 2, further including means coupled to the lifting rod for biasing the lid towards the base.

4. The assembly of claim 1, further including means coupled to the link assembly for slowing the closing motion of the lid.

5. The assembly of claim 4 wherein the slowing means includes a damping wheel fixedly secured to the base, and a sliding bar that is operationally coupled to the damping wheel and which is secured to a pedal bar.

6. The assembly of claim 1, wherein the lid comprises two separate lid portions, with each lid portion coupled to the shell in a manner such that the two lid portions pivot away from each other.

7. The assembly of claim 6, wherein the shell has a pair of opposing side edges at its top end, and wherein each lid portion is pivotably secured to one of the opposing side edges.

* * * * *